US007072378B2

(12) United States Patent
Richardson et al.

(10) Patent No.: US 7,072,378 B2
(45) Date of Patent: Jul. 4, 2006

(54) INDUCTION HEATING APPARATUS AND METHODS FOR SELECTIVELY ENERGIZING AN INDUCTOR IN RESPONSE TO A MEASURED ELECTRICAL CHARACTERISTIC THAT IS AT LEAST PARTIALLY A FUNCTION OF A TEMPERATURE OF A MATERIAL BEING HEATED

(75) Inventors: John G. Richardson, Idaho Falls, ID (US); John L. Morrison, Butte, MT (US); Grant L. Hawkes, Sugar City, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 22 days.

(21) Appl. No.: 10/926,899

(22) Filed: Aug. 25, 2004

(65) Prior Publication Data

US 2006/0050761 A1 Mar. 9, 2006

(51) Int. Cl.
*H05B 6/06* (2006.01)

(52) U.S. Cl. ..... 373/145; 373/148

(58) Field of Classification Search ..... 373/1, 373/5–7, 138–151
See application file for complete search history.

(56) References Cited

U.S. PATENT DOCUMENTS 3,601,717 A 8/1971 Kuecken
3,686,460 A 8/1972 Lamparter et al.
4,280,038 A 7/1981 Havas et al.
4,679,007 A 7/1987 Reese et al.
4,738,713 A * 4/1988 Stickle et al. ..... 373/140
4,866,592 A 9/1989 Fujii et al.
5,109,389 A * 4/1992 Stenzel ..... 373/156

(Continued)

OTHER PUBLICATIONS

"IGBT Induction Heating Generator," MSI Automation Inc. <http://www.msiautomation.com/control-panell.html>, Nov. 2003, 2 pages.

*Primary Examiner*—Tu Hoang
(74) *Attorney, Agent, or Firm*—TraskBritt, P.C.

(57) ABSTRACT

An induction heating apparatus includes a measurement device for indicating an electrical resistance of a material to be heated. A controller is configured for energizing an inductor in response to the indicated resistance. An inductor may be energized with an alternating current, a characteristic of which may be selected in response to an indicated electrical resistance. Alternatively, a temperature of the material may be indicated via measuring the electrical resistance thereof and a characteristic of an alternating current for energizing the inductor may be selected in response to the temperature. Energizing the inductor may minimize the difference between a desired and indicated resistance or the difference between a desired and indicated temperature. A method of determining a temperature of at least one region of at least one material to be induction heated includes correlating a measured electrical resistance thereof to an average temperature thereof.

41 Claims, 11 Drawing Sheets

U.S. PATENT DOCUMENTS 5,165,049 A 11/1992 Rotman
5,523,631 A 6/1996 Fishman et al.
5,675,476 A 10/1997 Nostwick
5,892,790 A * 4/1999 Abiko et al. ..... 373/158
5,940,427 A 8/1999 Hurtgen et al.
6,026,050 A 2/2000 Baker et al.
6,078,033 A 6/2000 Bowers et al.
6,144,690 A 11/2000 Kusamichi et al.
6,163,019 A 12/2000 Green et al.
6,174,570 B1 1/2001 Dambrine et al.
6,185,243 B1 2/2001 Boen et al.
6,255,635 B1 7/2001 Thompson et al.
6,307,875 B1 10/2001 Tsuda et al.
6,414,982 B1 7/2002 Rake et al.
6,618,426 B1 9/2003 Ernst
6,817,212 B1 * 11/2004 Romer et al. ..... 373/156

* cited by examiner

INDUCTION HEATING APPARATUS AND METHODS FOR SELECTIVELY ENERGIZING AN INDUCTOR IN RESPONSE TO A MEASURED ELECTRICAL CHARACTERISTIC THAT IS AT LEAST PARTIALLY A FUNCTION OF A TEMPERATURE OF A MATERIAL BEING HEATED

GOVERNMENT RIGHTS

The United States Government has rights in the following invention pursuant to Contract No. DE-AC07-99ID13727 between the U.S. Department of Energy and Bechtel BWXT Idaho, LLC.

CROSS REFERENCE TO RELATED APPLICATIONS

This application is related to U.S. application Ser. No. 10/926,900 entitled INDUCTION HEATING APPARATUS AND METHODS OF OPERATION THEREOF, filed on Aug. 25, 2004.

FIELD OF THE INVENTION

Field of the Invention: The present invention relates generally to induction melting apparatus for use in heating at least one material. More particularly, embodiments of the present invention relate to methods of indicating a temperature of a molten material and methods of control of induction heating apparatuses.

BACKGROUND OF THE INVENTION

Induction heating apparatuses have been employed for heating a variety of materials without direct contact therewith. For instance, heat treating of metals and melting of materials may be accomplished by induction heating. Further examples of induction heating applications include, without limitation, annealing, bonding, brazing, forging, stress relief, and tempering. Additionally, powder metallurgy applications may relate to heating of a mold or other member which, in turn, heats a powder metallurgy composition to be melted. Metal or other casting applications may also utilize induction heating. Accordingly, as known in the art, induction heating may be useful in various industries and applications.

For instance, one particular application for induction heating relates to treatment and storage of such hazardous materials and is known as "vitrification." Hazardous materials may be vitrified when they are combined with glass forming materials and heated to relatively high temperatures. During vitrification, some of the hazardous constituents, such as hazardous organic compounds, may be destroyed by the high temperatures, or may be recovered as fuels. Other hazardous constituents, which are able to withstand the high temperatures, may form a molten state, which then cools to form a stable vitrified glass. The vitrified glass may demonstrate relatively high stability against chemical and environmental attack as well as a relatively high resistance to leaching of the hazardous components contained therein.

One type of induction heating apparatus that has proven to be effective to vitrify waste materials is a cold-crucible-induction melter (CCIM). A cold-crucible-induction melter may typically comprise a water-cooled crucible disposed within an induction coil, or other inductor, usually formed along a spiral path surrounding therearound. Generally, an induction coil carries varying electric currents that generate associated varying electromagnetic fields for inducing eddy currents within electrically conductive materials encountered thereby. The varying electromagnetic fields generated by the current within an inductor may be described as the "flux" thereof.

Waste may be induction heated directly if it is sufficiently electrically conductive and thereby vitrified. However, the waste and glass forming materials used in vitrification systems may be relatively non-electrically conductive at room temperatures. Therefore, an electrically conductive material may be used to initially indirectly heat at least a portion of the waste to a molten state, at which point the waste may become more electrically conductive so that when varying current is conducted through the induction coil, conductive molten waste may be induction heated by way of eddy currents generated therein. Of course, non-electrically-conductive waste materials nearby the electrically conductive molten waste, due to the heat generated therein, may be indirectly heated and thus, melted.

As a further advantage of cold-crucible-induction melter vitrification systems, molten glass within the water-cooled crucible may form a solid layer (skull layer), which inhibits or prevents direct contact of the high temperature molten glass with the interior surface of the crucible. Furthermore, because the crucible itself is cooled with water, in combination with the insulative properties of the skull layer, high-temperature melting may be achieved without being substantially limited by the heat-resistance or melting point of the crucible.

FIG. 1 shows a perspective view of a conventional induction melter 10. Generally, cold-crucible-induction melter 10 includes head assembly 20 affixed to disengagement spool 40 by way of mating lower flange 21 and upper flange 39 of head assembly 20 and disengagement spool 40, respectively. Disengagement spool 40 is affixed to furnace body 30 by way of lower flange 37, which is affixed to the upper flange 31 of the furnace body 30. Head assembly 20 includes off-gas port 12 for removing gasses from the cold-crucible-induction melter 10 during operation, feed port 14 for adding material to the cold-crucible-induction melter 10, and view port 15 for observing the conditions within the cold-crucible-induction melter 10. Furnace body 30 may include cooling tubes 22 disposed therearound, which may be supplied with a cooling medium, such as water, by way of inlet 23 and outlet 25 for cooling the crucible (not shown) and may also include a bottom drain assembly (not shown) for discharging vitrified waste material from the crucible during operation of the cold-crucible-induction melter 10.

FIG. 2A shows a side cross-sectional view of the cold-crucible-induction melter 10 shown in FIG. 1. More particularly, an induction heating system 90 comprising an induction coil 26, a power source 100, and electrical conductors 110 extending therebetween may be configured for delivering heat to the interior of crucible 56. In further detail, induction heating system 90 may include an induction coil 26 disposed generally about the furnace body 30 of the cold-crucible-induction melter 10 as known in the art (cooling tubes 22 have been omitted from FIGS. 2A–2D for clarity). Both electrical conductors 110 and induction coil 26 may be water-cooled, as known in the art. Power source 100 may comprise a variable-frequency power supply, such as a generator-type or a solid state power supply, which is configured for energizing the induction coil 26 with a selectable, alternating electrical waveform having a magnitude and a frequency wherein at least one of the magnitude and frequency is variable. As known in the art, the power source 100 may be operably coupled to or integrally inclusive of a capacitor "bank" or one or more variable capacitors and a transformer that are configured (separately or in combination) for "tuning" (automatically or manually) the resonant frequency of the induction heating circuit with respect to the load (i.e., the material to be heated).

FIG. 2B shows a side cross-sectional view of the cold-crucible-induction melter 10 shown in FIG. 1 including granular material 55, which may be disposed within crucible 56. For instance, granular material 55 may comprise hazardous materials and glass forming materials, without limitation. Also, susceptor 120 may be positioned in contact with the granular material 55 and may be configured for heating, in response to energizing induction coil 26, to a temperature sufficient to melt at least a portion of the granular material 55 proximate thereto. For instance, susceptor 120 may comprise graphite and may be shaped as a ring or as otherwise desired. The presence of a susceptor 120 may be necessary to initially melt at least a portion of the granular material 55, because the granular material 55 may not be electrically conductive when solid. Of course, conversely, if granular material 55 is electrically conductive in a non-molten state, susceptor 120 may be omitted as being unnecessary.

During initial operation of the induction heating system 90 of the cold-crucible-induction melter 10 as shown in FIG. 2B, assuming granular material 55 is not electrically conductive, induction coil 26 carrying an alternating current induces eddy currents within susceptor 120, thus heating susceptor 120. As susceptor 120 increases in temperature, granular material 55 proximate to susceptor 120 may be heated and may form a region of molten material 50 adjacent susceptor 120, as shown in FIG. 2C. Inductive heating by energizing induction coil 26 with an alternating current may then proceed by way of induced electrical currents within the molten material 50, assuming such molten material 50 becomes electrically conductive, in combination with heating of susceptor 120 by way of induced electrical currents therein until substantially the interior of crucible 56 comprises molten material 50, surrounded by skull layer 52, as explained further hereinbelow and shown in FIG. 2D.

Referring to FIG. 2D, granular material 55 may be introduced within cold-crucible-induction melter 10 through feed port 14 and ultimately melted to form molten material 50, which may substantially fill crucible 56. Susceptor 120 (FIGS. 2B and 2C) may be sacrificial, and may substantially oxidize (burn off) or may break into several pieces within molten material 50. As noted previously, crucible 56 may be surrounded by cooling tubes 22 (FIG. 1) for flowing water or gas through in order to cool the crucible 56 during operation, because the temperatures that may be required to vitrify waste materials may exceed the melting point of the crucible 56. The desired steady-state operational temperature for vitrifying waste material may be about 1200° Celsius. Cooling the crucible 56 during heating of the waste may form a skull layer 52 comprising solidified material (previously molten material 50) disposed along the inner surface of the side wall of the crucible 56. The skull layer 52 may be from a few millimeters to several inches in thickness, and may insulate the molten material 50 within the crucible 56 and also inhibit the molten material 50 from directly contacting and damaging the inner surface of the crucible 56. Skull layer 52 may span a relatively extreme temperature gradient between the cooling water temperature within cooling tubes 22, which may be less than about 100° Celsius, and the molten material 50 temperature, which may be greater than about 1000° Celsius. Of course, the relative thickness of the skull layer 52 may vary depending on the thermal environment of the crucible 56.

Also, cold cap 54, comprising granular material 55 and, possibly, condensed off-gas material, may preferably exist upon the upper surface of molten material 50 under preferred conditions. Cold cap 54 may reduce volatization of molten material 50 and may also insulate molten material 50. Impact zone 59 indicates a region of cold cap 54 that granular material 55, shown as entering the cold-crucible-induction melter 10 through feedport 14, may fall upon and accumulate. Dust, volatized material, and evolved gases 57 may exit or move upwardly away from the impact zone 59 of cold cap 54 into the plenum volume 200. Ultimately, dust, volatized material, and evolved gases 57 may subsequently condense, deposit, or settle onto cold cap 54, adhere to the inner wall of disengagement spool 40 or head assembly 20, respectively, or exit the plenum volume 200 through offgas port 12.

Induction coils 26 surrounding crucible 56 may be energized with relatively large alternating currents to induce currents within the waste material to be heated. Typically, induction coils 26 may be fabricated from a highly electrically conductive material, such as copper, and are cooled by water or another fluid flowing therein. As known in the art, waste materials, such as radioactive waste or other waste may be combined with glass forming constituents, heated, and thereby vitrified.

Conventional induction heating systems may be configured for heating in response to a temperature set-point, which may be time-varying. More particularly, conventional induction heating systems may be configured for varying the output power of the power source in relation to an error signal equal to the difference between a desired set-point in relation to a measured temperature of the material to be heated that is measured or indicated by way of thermocouple or optical pyrometer. For example, in one configuration, a desired set-point may be communicated electrically to a proportional, integral, and derivative ("PID") type control algorithm, including user-settable or auto-setting constants, and the output of the induction heating system may be determined therewith, as known in the art.

As may be appreciated by the above discussion of the operation and configuration of a cold-crucible-induction melter 10, it may be difficult to measure or ascertain the temperature of the molten material 50 therein. Particularly, one conventional approach may include insertion of at least one thermocouple into molten material 50. However, the power source 100 of induction heating system 90 may induce heat within a thermocouple and, therefore, may potentially damage a thermocouple. Alternatively, in another conventional approach for measuring the temperature of the molten material 50, an optical pyrometer may be employed for indicating a temperature of molten material 50. An optical pyrometer, as known in the art, may indicate the temperature of a surface of a material by measuring the energy radiating from a material (for one or more wavelengths) and relating the measured energy, in consideration of the spectral emissivity of the material, to the temperature of the material. However, as best seen in FIG. 2B, a clear viewing path of molten material 50 for operation of an optical pyrometer may be relatively difficult to establish, use, or reliably maintain, because skull layer 52, cooling tubes 22, induction coil 26, cold cap 54, granular material 55, as well as dust, volatized material, and evolved gases 57 may substantially interfere with radiation from molten material 50. Thus, there may be substantial difficulties in obtaining reliable measured temperature information relating to the molten material 50, which may complicate operation of the cold-crucible-induction melter 10.

In the absence of reliable direct temperature measurements of molten material 50, conventional cold-crucible-induction melters may be controlled manually. For example, conventional cold-crucible-induction melters may be controlled by "feel" or by secondary indications such as the "frequency pulling" in relation to the applied frequency of an induction power source 100. Accordingly, it may be desired to control the output of the power source 100 of cold-crucible-induction melter 10 in relation to the temperature of the molten material 50, automatically or otherwise. Thus, there exists a need for an improved apparatus and method for indicating, controlling, or both indicating and controlling or regulating the temperature distribution within a cold-crucible-induction melter.

In view of the foregoing problems and shortcomings with conventional induction heating apparatus and methods of operation thereof, it would be advantageous to provide improved induction heating apparatus and methods of operation thereof.

BRIEF SUMMARY OF THE INVENTION

The present invention relates to an induction heating apparatus and methods of operation thereof. For example, one particular type of induction heating apparatus may be a cold-crucible-induction melter. While the following discussion relates to a cold-crucible-induction melter for melting at least one material, the present invention is not so limited. Rather, the present invention relates to induction heating apparatus for use as known in the art, without limitation.

Particularly, a crucible having a wall disposed about a longitudinal axis and a bottom extending generally radially inwardly from the wall toward the longitudinal axis may be provided. Further, the walls of the crucible may be cooled and at least one material may be provided within the crucible. An inductor may be provided and disposed proximate the crucible and in operable communication with an induction heating circuit, the induction heating circuit including a power source.

Further, an electrical resistance of the at least one material may be indicated and at least one alternating current characteristic may be selected in response to the indicated electrical resistance of the at least one material. Finally, the inductor may be energized with an alternating current exhibiting the at least one alternating current characteristic. In a further aspect of the present invention, the at least one alternating current characteristic may be selected for minimizing the difference between a desired electrical resistance and the indicated electrical resistance of the at least one material. For instance, a feedback control loop configured for energizing the inductor to minimize the difference between the desired electrical resistance and the indicated electrical resistance of the at least one material may be implemented.

In another method of controlling an induction heating process according to the present invention, a temperature of at least one material may be indicated via measuring the electrical resistance of the at least one material and at least one alternating current characteristic in response to an indicated temperature of the at least one material may be selected. The inductor may be energized with an alternating current exhibiting the selected at least one alternating current characteristic. In a further aspect of the present invention, the at least one alternating current characteristic may be selected for minimizing the difference between a desired temperature and the indicated temperature of the at least one material. For instance, a feedback control loop configured for energizing the inductor to minimize the difference between the desired temperature and the indicated temperature of the at least one material may be implemented.

The present invention also relates to a method of determining a temperature of at least one material within a cold-crucible-induction melter. In further detail, a crucible having a wall disposed about a longitudinal axis and a bottom extending generally radially inwardly therefrom may be provided. Further, the walls of the crucible may be cooled and at least one material may be provided within the crucible. An inductor may be provided and disposed proximate the crucible and in operable communication with an induction heating circuit, the induction heating circuit including a power source.

The electrical resistance of at least one region of the at least one material within the crucible may be measured and an average temperature of the at least one region of the at least one material may be determined by correlating the measured electrical resistance of the at least one region of the at least one material to an average temperature thereof. Extrapolating further, an average temperature of each of more than one region may be determined by measuring an electrical resistance of each of more than one region and correlating the measured electrical resistance of each of the more than one region of the at least one material to an average temperature thereof, respectively.

The present invention also relates to an induction heating apparatus. More specifically, an induction heating apparatus of the present invention may include a crucible and a cooling structure disposed about the crucible for cooling thereof. In addition, an inductor may be disposed proximate the crucible and an induction heating circuit including a power supply having an electrical output may be operably coupled to the inductor and configured for delivering an alternating current therethrough. Further, the induction heating apparatus may comprise a measurement device configured for indicating an electrical resistance of an anticipated at least one material positioned within the crucible for inductive heating via energizing the inductor. Additionally, the induction heating apparatus may include a controller configured for selecting at least one characteristic of the alternating current for energizing the inductor in response to the indicated electrical resistance of the at least one material.

BRIEF DESCRIPTION OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

Figure 1:
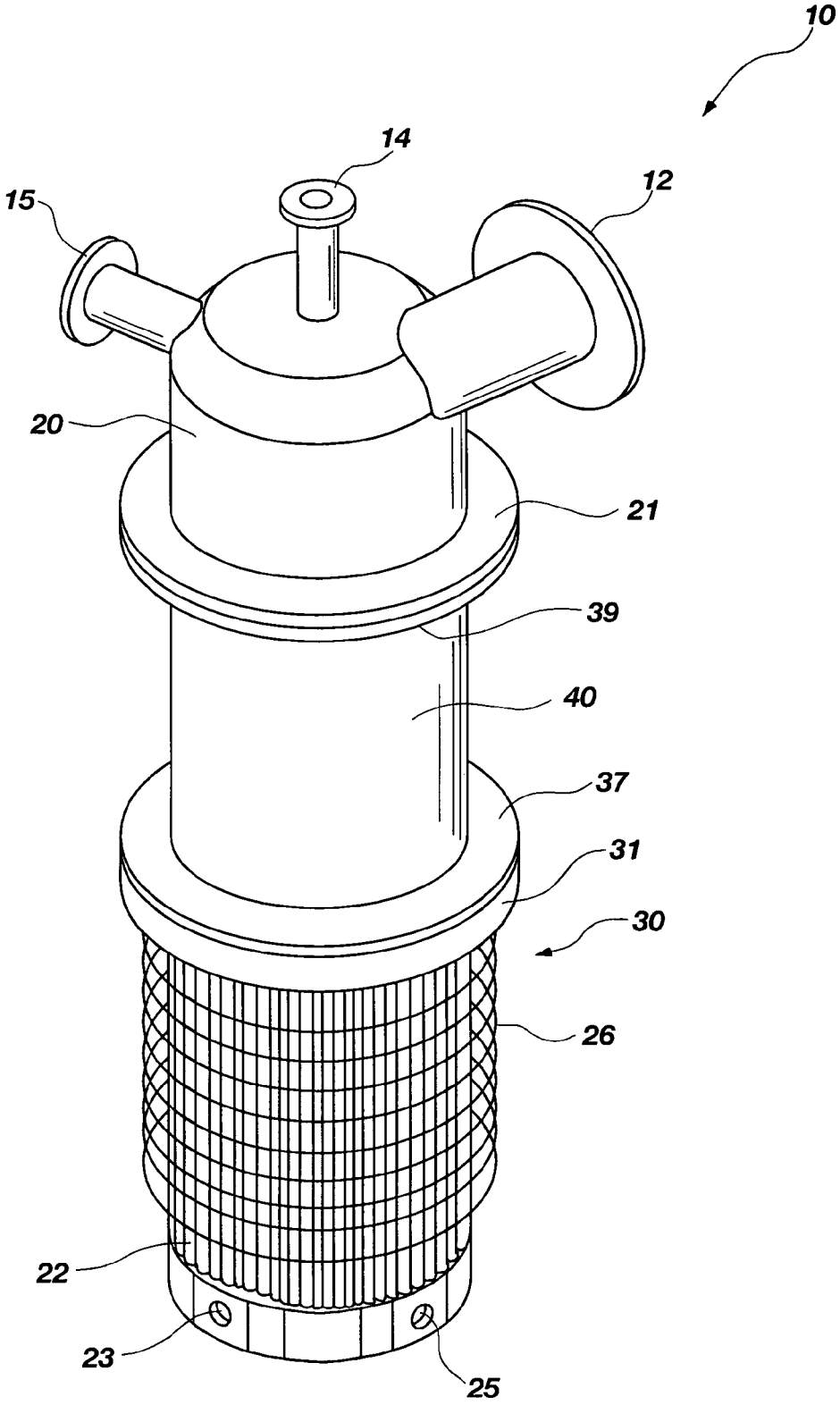
FIG. 1 (PRIOR ART)
FIG. 1 illustrates a perspective view of a cold-crucible-induction melter.

The present invention relates to control of an induction heating process. More particularly, the methods of the present invention may pertain to controlling or regulating induction heating processes employed in a cold-crucible-induction melter 10 as shown in FIGS. 1–2D, as described hereinabove.

In one aspect of the present invention, the resistance of the molten material 50 may be measured, estimated, or indicated. Generally, an induction heating circuit model pertaining to the induction power source 100, induction coil 26, molten material 50, and various other electrical properties that affect the electrical behavior of the induction coil 26 may be produced, and a solution for the resistance of the molten material 50 may be obtained.

Figure 3:
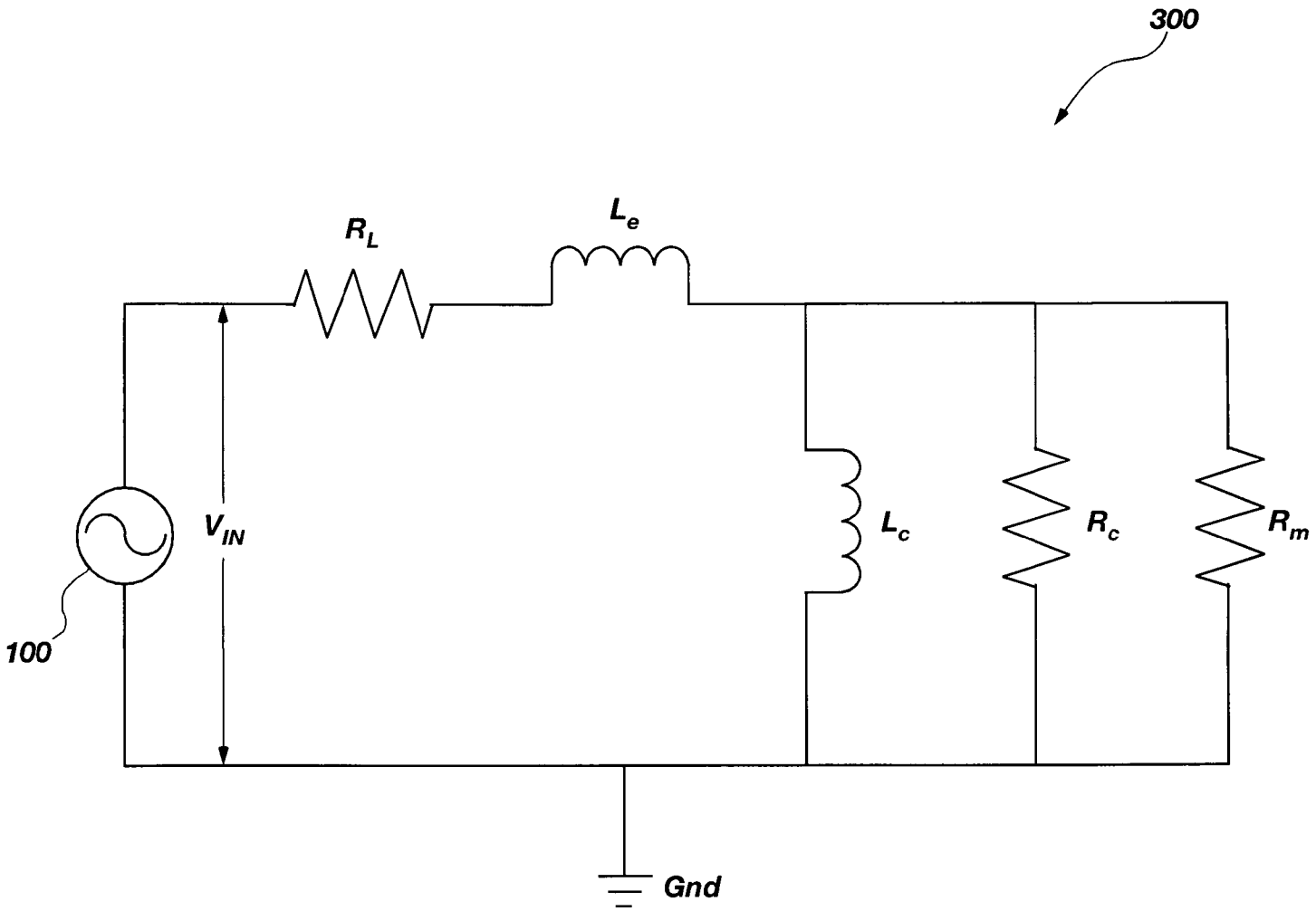
FIG. 3 illustrates a schematic induction heating circuit model.

For instance, the induction heating system 90 and molten material 50 may be modeled, approximated, or simulated as shown by the induction heating circuit model 300 shown in FIG. 3, where the power source 100 supplies $V_{IN}$ to the induction heating circuit model 300. The induction heating circuit model 300 comprises a wiring resistance $R_L$, a leakage inductance $L_E$, a coil inductance $L_C$, a coil resistance $R_C$, and a melt resistance $R_M$.

Further, by Ohm's law, $$\frac{V_{IN}}{I_{IN}} = Z_{IN} = \alpha + j\beta \qquad \text{Equation 1}$$

Wherein:

$V_{IN}$ is the voltage applied to the induction heating circuit model 300;

$I_{IN}$ is the current flowing through the induction heating circuit model 300; and $Z_{IN}$ is the impedance of the induction heating circuit model 300;

$\alpha$ is the real component of the impedance of the induction heating circuit model 300; and $j\beta$ is the imaginary component of the impedance of the induction heating circuit model 300.

Also, $$Z_{IN} = R_L + j\omega L_E + \frac{j\omega L_C \frac{R_M R_C}{R_M + R_C}}{j\omega L_C + \frac{R_M R_C}{R_M + R_C}} \qquad \text{Equation 2}$$

Wherein:

$R_M$ is the electrical resistance of the molten material 50;

$R_C$ is the electrical resistance of the induction coil 26;

$R_L$ is the electrical resistance of the wiring from the power source 100 to the induction coil 26;

$L_C$ is the impedance of the induction coil 26; and $L_E$ is the electrical inductance of the wiring from the power source 100 to the induction coil 26.

Setting Equation 1 equal to Equation 2 and then solving for both the imaginary component and the real component gives respective solutions for $R_M$. For instance, in the case of heating a material that is initially nonconductive, at least one measurement relating to the heating circuit may be performed when the resistance of $R_M$ is infinite (i.e., non-conductive). Such at least one measurement may provide respective values for the variables other then $R_M$ in Equation 2. Then, $R_M$ may be solved for responsive to the material becoming electrically conductive, since $R_M$ would be the sole unknown.

Thus, $R_M$ may be determined by appropriate analysis of Equation 2. However, it should be noted that the above analysis pertaining to a mathematical solution for $R_M$ may be substantially varied, depending upon the underlying induction heating circuit model 300 that is employed. The present invention also contemplates that modifications, additions, simplifications, or other variations of the induction heating circuit model 300 shown in FIG. 3 and analysis thereof may be employed by the present invention, without limitation.

Thus, in one method of control or regulation of an induction heating system 90 of the present invention, a desired melt resistance set point may be selected and a difference between the desired resistance of molten material 50 and an indicated resistance of molten material 50 may be used to determine the output from the induction power source 100. Put another way, the heating of the molten material 50 via induction heating system 90 may be controlled, via selecting at least one characteristic of an alternating current for energizing the induction coil 26 to minimize the difference between a desired electrical resistance of molten material 50 and an indicated electrical resistance of the molten material 50. For instance, at least one of the amplitude and frequency of the alternating current communicated through the induction coil 26 may be selected.

For completeness, it should be recognized that the method of control of induction heating system 90 via resistance of the molten material 50 may be employed in combination with other methods of controlling induction system 90. Particularly, as described above, since the electrical resistivity of granular material 55 may be substantially infinite (i.e., non-conductive) for temperatures under about 800° Celsius, other modes of control may be employed until at least a portion of granular material 55 becomes molten.

One approach for melting at least a portion of granular material 55 may be to select a substantially constant (frequency and amplitude) electrical output from the power source 100 for energizing the induction coil 26 for a selected amount of time. The specific characteristics of the electrical output of the power source 100 for energizing the induction coil 26 may be selected based on one or more of the following: the amount of granular material 55 within the crucible 56, the melting temperature of the granular material 55, the relative amount of electrical power generated within the susceptor 120 via the induction coil 26, the material comprising the susceptor 120, the size of the susceptor 120, and the ambient conditions (the temperature, humidity, etc.) influencing the induction heating system 90, or the granular material 55. Of course, simulations or modeling may be used to predict the heating response to energizing induction coil 26. For instance, heating of susceptor 120, the granular material 55 therewith, or both may be simulated or modeled.

Alternatively or additionally, there may be other methods for determining whether at least a portion of the granular material 55 has been melted. For instance, if the susceptor 120 is visually or otherwise observable, such observation may indicate that a portion of granular material 55 has been melted. For instance, if the susceptor 120 is initially in contact with granular material 55, melting of the granular material 55 in proximity to susceptor 120 may cause the susceptor 120 to become visually observable. Alternatively, if the susceptor 120 changes position (i.e., floats or sinks within molten material 50), such a change in position may be detected and may indicate the presence of molten material 50.

Upon at least a portion of granular material 55 becoming molten and, therefore, electrically conductive, the molten material 50 may be heated directly via the electromagnetic flux of induction coil 26. Upon at least a portion of the granular material 55 forming molten material 50, control or regulation of an alternating current for energizing the induction coil 26 to minimize or reduce the difference between a selected electrical resistance set point and an electrical resistance of the molten material 50 may be employed.

The electrical resistivity of molten material 50 may be determined according to the approach described above, automatically or as otherwise known in the art. For instance, a measurement device, such as a computer including, optionally, a data acquisition system, may be employed to indicate the electrical resistivity of at least one material to be inductively heated. Additionally, a measurement device may be configured to measure at least one electrical characteristic of portions of the induction system 90 for calculating $R_M$.

Figure 4:
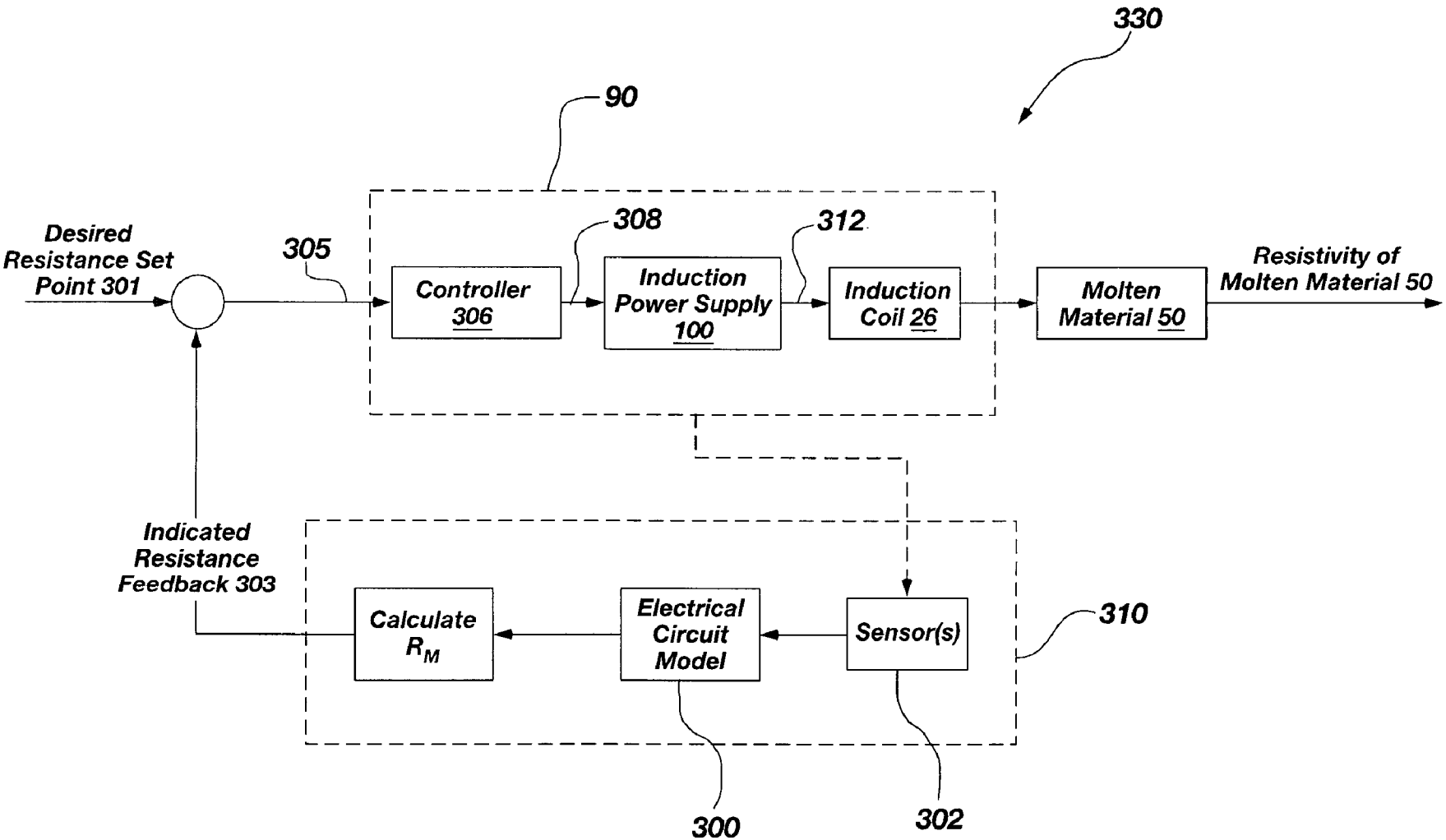
FIG. 4 illustrates a schematic representation of a feedback control loop according to the present invention.

Extrapolating further, the ability to calculate or measure $R_M$ may provide a feedback signal for controlling the output from the induction power source 100 for energizing the induction coil 26. As shown in FIG. 4, a schematic representation of a feedback control loop 330 is shown wherein a desired resistance set point 301 may be compared to an indicated resistance feedback 303. The difference between the desired resistance set point 301 and the indicated resistance feedback 303 may be used as a so-called error signal 305, which forms a basis for a control signal 308 generated by controller 306. In further detail, controller 306 may comprise an apparatus that implements an algorithm based on, at least in part, the difference between the desired resistance set point 301 and the indicated resistance feedback 303 to generate a control signal 308 communicated to power source 100. The control signal 308 may be used to regulate or determine at least one characteristic of alternating current 312 supplied to the induction coil 26. For example, at least one of the frequency and amplitude of the alternating current 312 may be adjusted, thus correspondingly affecting the heating of molten material 50. Alternatively or additionally, the time-varying shape of the alternating current 312 may be adjusted, without limitation.

Controller 306 may implement a so-called proportional, integral, and derivative type ("PID") control algorithm for regulation of $R_M$ of molten material 50. Of course, controller 306 may comprise a controller as known in the art, without regard to the design of the algorithm implemented therewith. Furthermore, controller 306 may implement logic, timers, limits, alarms, or other controlling functions as known in the art or as otherwise desired. Thus, the control signal 308 may be developed in consideration of a number of inputs, measurements, or indications, without limitation.

For instance, in recognition that the amount of molten material 50 may be relatively small initially in comparison to the amount of granular material 55, it may be desirable to limit the amount of power that is applied or generated therein, to avoid overheating. Thus, an upper limit may be imposed on the electrical power communicated through the induction coil 26 for a selected amount of time.

Indicated resistance feedback 303 may be calculated by measurement of one or more electrical properties or operational conditions related to induction system 90. At least one sensor 302 may measure voltage, resistance, inductance, capacitance, or, more generally, at least one property of an induction heating circuit for use in calculating, estimating, or otherwise determining $R_M$.

Such a configuration may be termed an estimator 310, because control or regulation of the induction power source 100 is performed via an indirect measurement of the resistance of the molten material 50. Put another way, the indicated resistance feedback 303 is determined by indirect indication, prediction, or estimation of the resistance of molten material 50.

In another method of the present invention, a temperature set point, which is obtained via a resistance measurement or indication thereof of the molten material 50, may be used for controlling the output from the induction power source 100. Explaining further, the electrical resistance of the molten material 50, $R_M$, may be determined and the temperature of the molten material 50 may be also determined therewith. The temperature of the molten material 50 may be indicated by the electrical resistance thereof, since the electrical resistance of molten material 50 may vary with temperature, as shown in greater detail hereinbelow.

Figure 5:
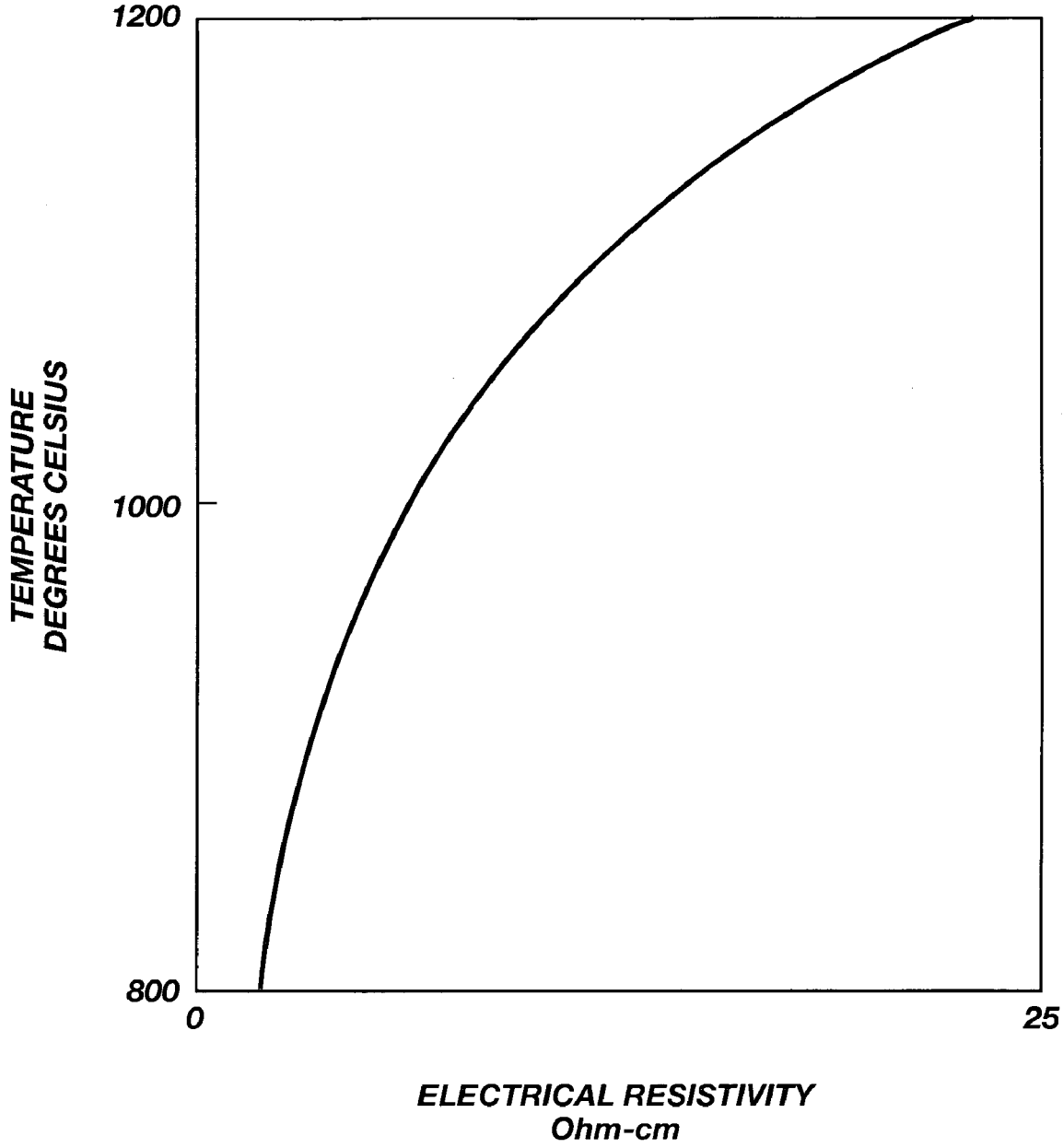
FIG. 5 illustrates a graph depicting the relationship between electrical resistivity of a molten glass material and a temperature thereof.

Generally, the electrical resistance of a material may vary by either increasing or decreasing with increases or decreases in temperature. For example, FIG. 5 shows a graph depicting a relationship between the temperature of a glass material known as "PSCM-20" and the resistance thereof. PSCM-20 glass may be representative of the materials commonly used for vitrification of hazardous waste. As may be appreciated, the electrical resistance of a material may vary substantially with changes in temperature. Referring to FIG. 5, the temperature shown in the Y-axis extends between a lower value of 800° Celsius to an upper value of 1200° Celsius, because PSCM-20 glass material may become molten only above about 800° Celsius. Therefore, for temperatures below about 800° Celsius, that is, at temperatures below which the vitrification materials (i.e., granular material 55) are molten, the electrical resistivity may be substantially infinite or non-conductive.

Figure 2A:
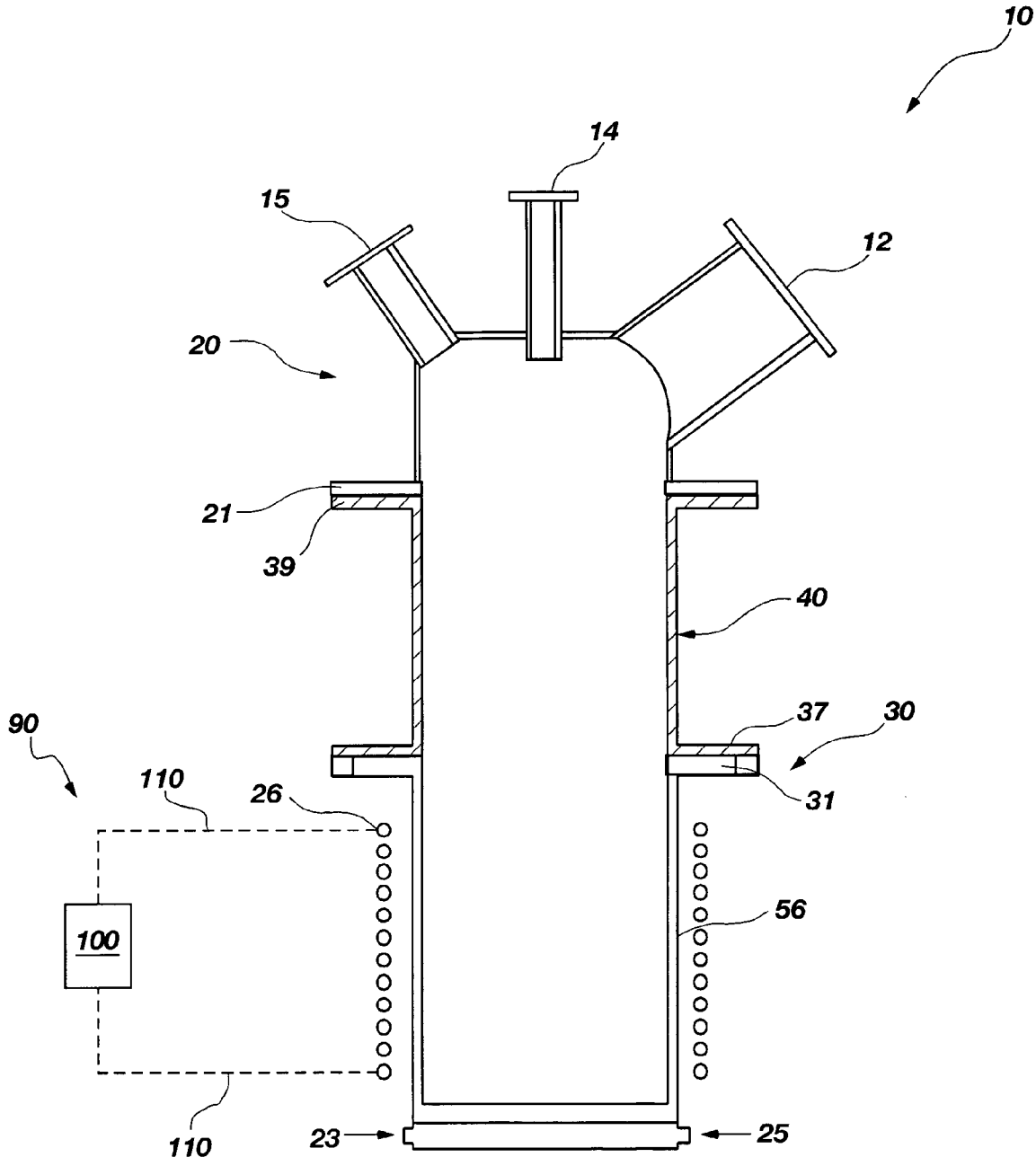
FIG. 2A (PRIOR ART)
FIG. 2A illustrates a schematic side cross-sectional view of the cold-crucible-induction melter shown in FIG. 1.
Figure 2B:
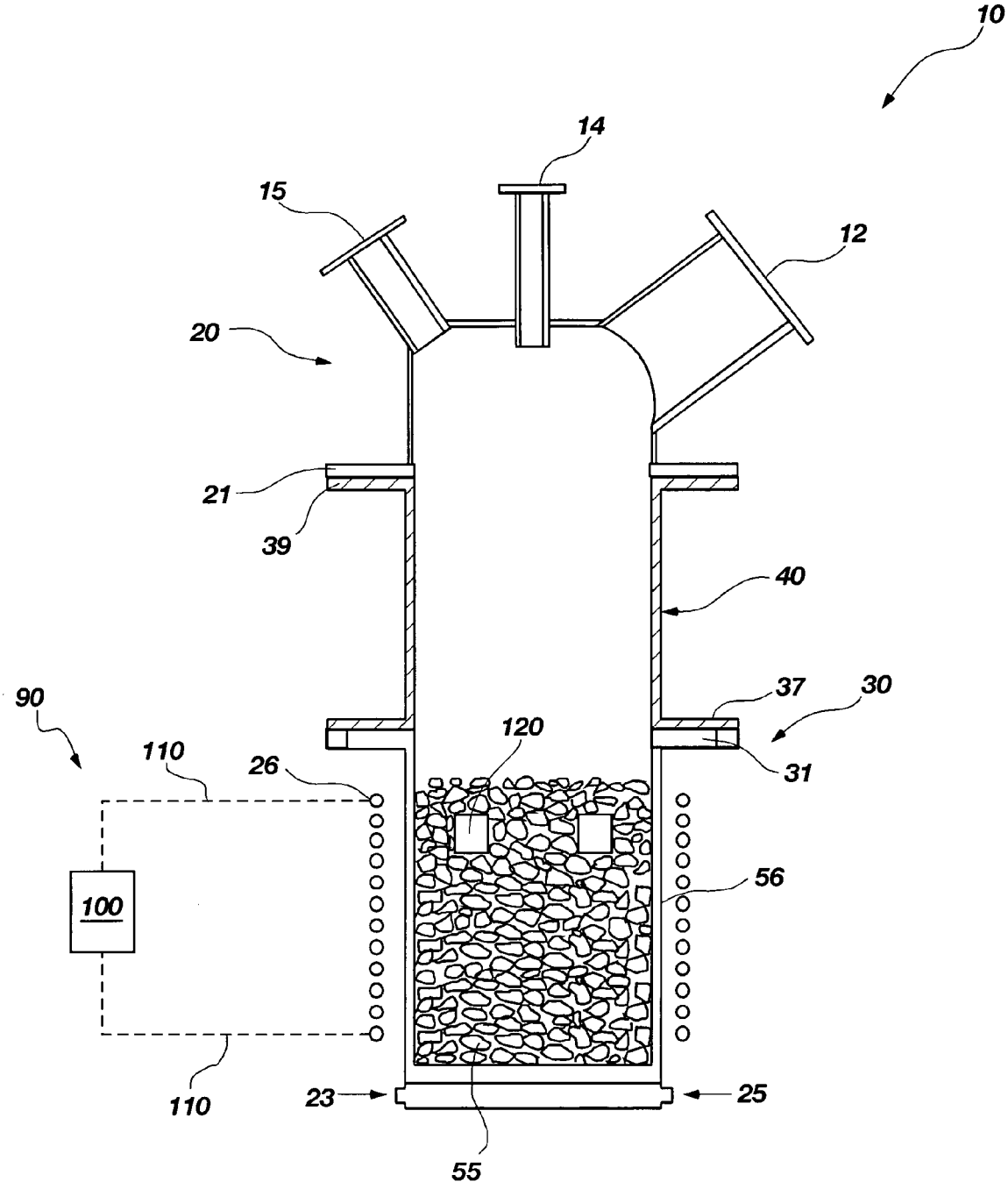
FIG. 2B (PRIOR ART)
FIG. 2B illustrates a schematic side cross-sectional view of the cold-crucible-induction melter shown in FIG. 1 during operation thereof.
Figure 2C:
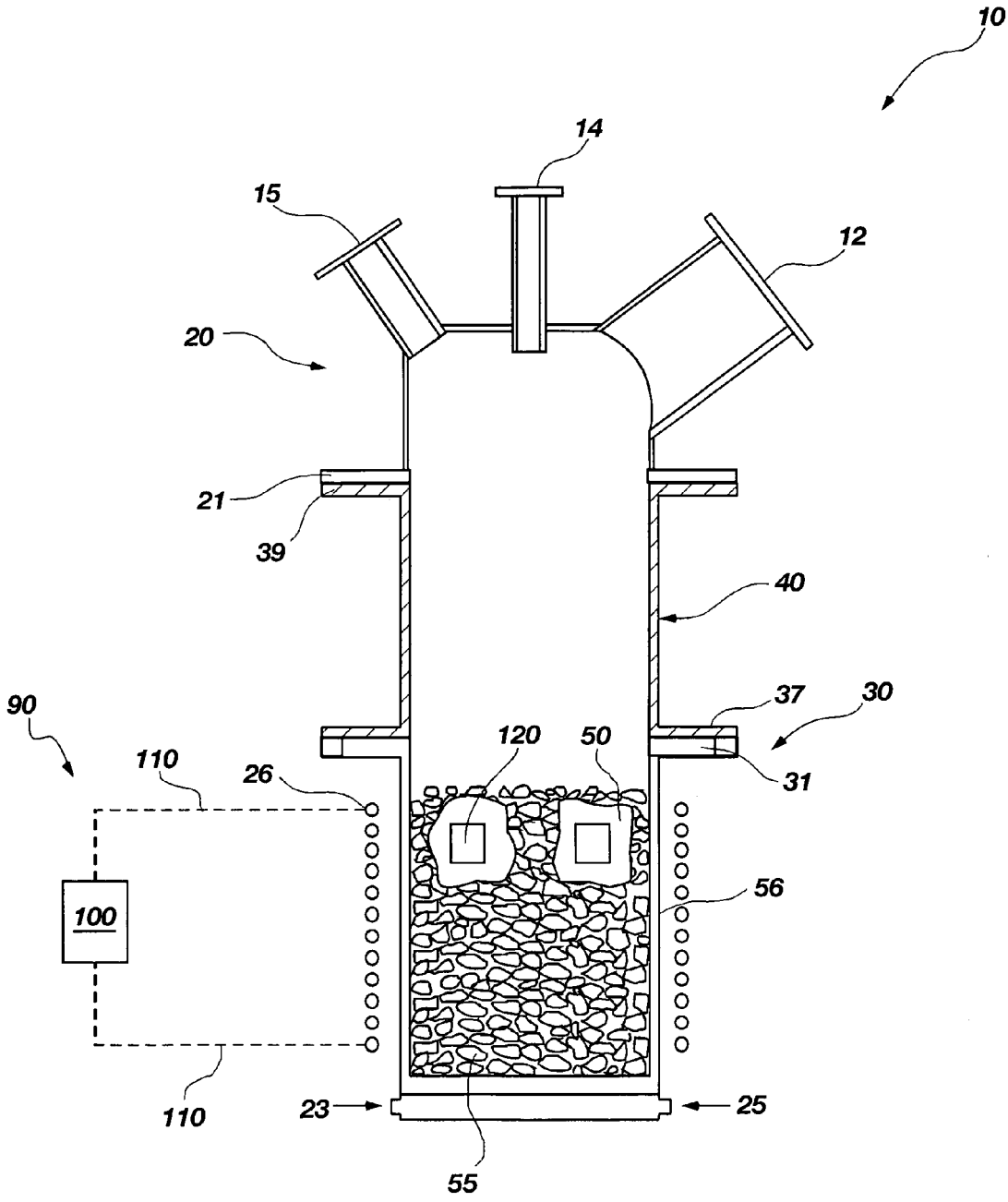
FIG. 2C (PRIOR ART)
FIG. 2C illustrates a schematic side cross-sectional view of the cold-crucible-induction melter shown in FIG. 1 during operation thereof.
Figure 2D:
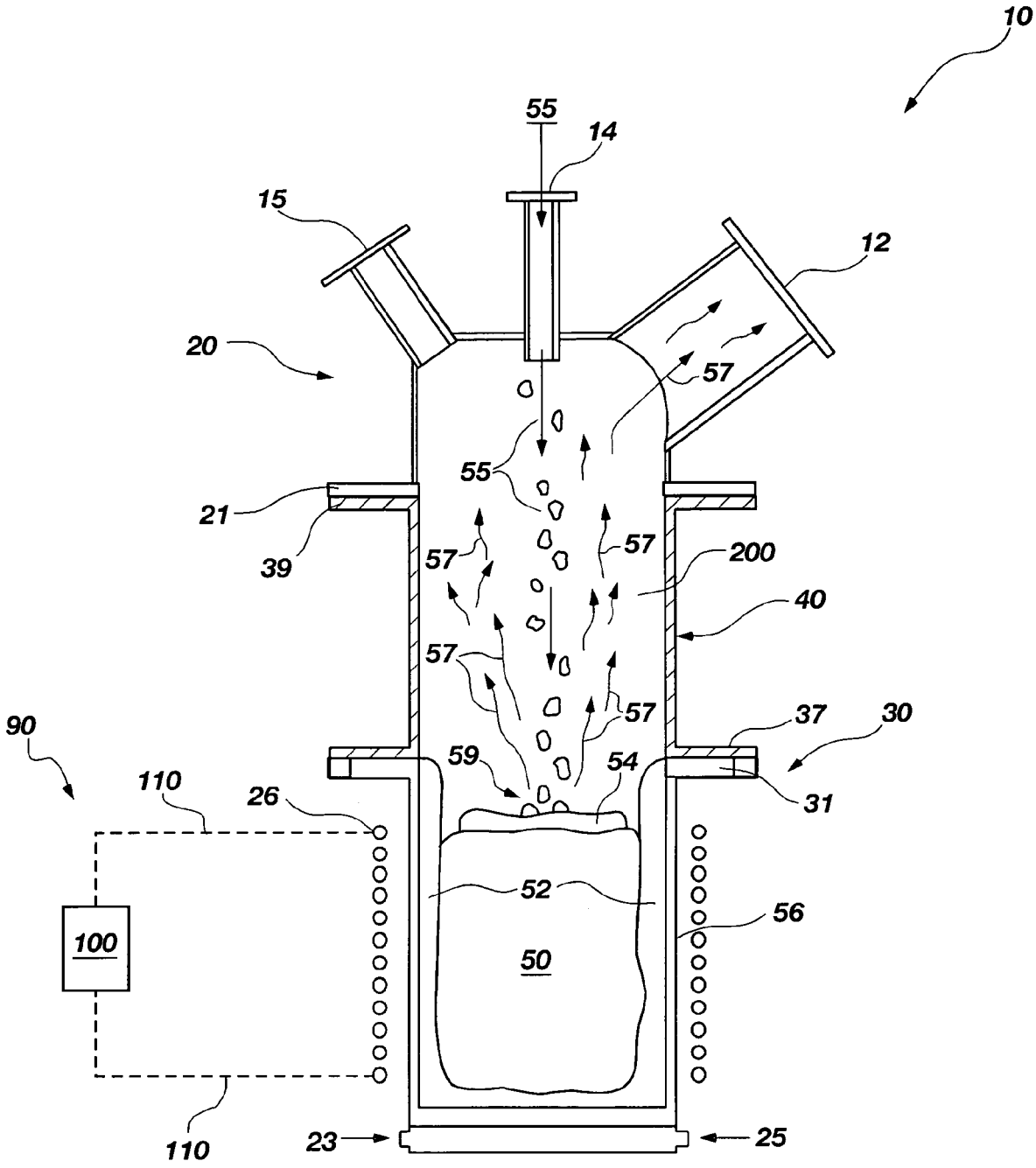
FIG. 2D (PRIOR ART)
FIG. 2D illustrates a schematic side cross-sectional view of the cold-crucible-induction melter shown in FIG. 1 during operation thereof.

Of course, once a mass of molten material 50 has been established, as shown in FIG. 2C, a vitrification process may proceed by expelling a portion of molten material 50 and adding granular material 55. Thus, while the range of temperature over which molten material 50 is electrical conductive or resistive of may be limited, substantially continuous operation of a cold-crucible-induction melter 10 may be desirable within such a range. Thus, substantially continuous operation of a cold-crucible-induction melter 10 may be performed according to the present invention, without limitation.

In a second method of operation of an induction system 90 of the present invention, generally, a selected or desired temperature set point may be selected and control of the induction heating process may proceed with reference thereto. Particularly, heating of at least one material via induction heating system 90 may be controlled, via selecting at least one characteristic of alternating current 312 for energizing the induction coil 26 so as to reduce the difference between the desired temperature of the at least one material being heated and a temperature thereof which is estimated or indicated by determining the electrical resistance of the at least one material and correlating the electrical resistivity of the at least one material to the temperature thereof.

Figure 6:
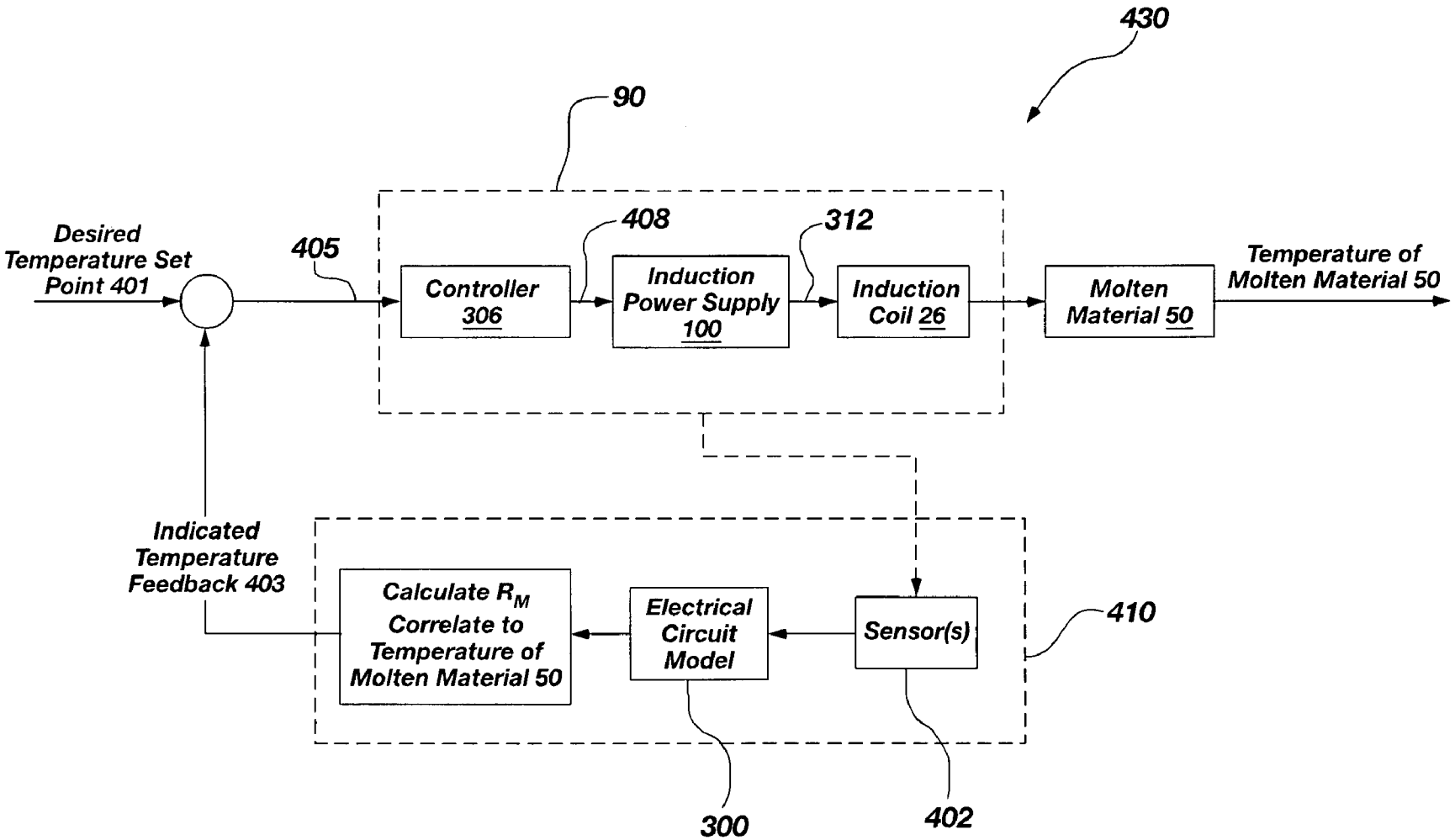
FIG. 6 illustrates a schematic representation of another feedback control loop according to the present invention.

As shown in FIG. 6, a schematic representation of a feedback control loop 430 is shown wherein a desired temperature set point 401 may be compared to an indicated temperature feedback 403. The difference between the desired temperature set point 401 and the indicated temperature feedback 403 may be used as a so-called error signal 405, which forms a basis for a control signal 408 generated by controller 306. In further detail, controller 306 may comprise an apparatus that implements an algorithm based on, at least in part, the difference between the desired set point 401 and the indicated temperature feedback 403 to generate a control signal 408 communicated to power source 100. The control signal 408 may be used to regulate or determine the alternating current 312 supplied to the induction coil 26. For example, at least one of the frequency or amplitude of the alternating current 312 may be adjusted for affecting the heating of a material such as, for instance, molten material 50.

As explained hereinabove, indicated temperature feedback 403 may be calculated by measurement of one or more electrical properties or operational conditions related to induction heating system 90. Sensor(s) 402 may measure voltage, resistance, inductance, capacitance, or other parameters that are useful in calculating, estimating, or otherwise determining a resistance and, ultimately, a temperature of at least one material heated by the inductor. For instance, with reference to molten material 50, $R_M$ may be measured and then may be correlated to a temperature of molten material 50, as described hereinabove in relation to FIG. 5. Such a configuration may be termed an estimator 410, because control or regulation of the induction power source 100 is performed via an indirect measurement of the temperature of the molten material 50.

In a further aspect of the present invention, it should be noted that the electrical resistance $R_M$ that may be indicated pertains to the region of the molten material 50 under the influence of the flux of the induction coil 26. Thus, the electrical resistance $R_M$ may indicate an average temperature of a portion or region of the molten material 50 influenced by the electromagnetic flux of the induction coil 26. Such a configuration may be advantageous, since conventional temperature sensors may indicate the temperature at a particular position (e.g., a thermocouple) or of a particular surface area (e.g., an optical pyrometer).

Generally, the skin depth of the electromagnetic flux may be defined as the depth to which eddy-currents are induced within a material heated by electromagnetic flux. The theoretical depth of penetration or skin depth ($d_0$) within a material to which an electromagnetic wave travels to is defined to be the depth at which the electromagnetic field or flux is reduced to 1/e or approximately 37 percent of its value at the surface. In the case of induction heating, the theoretical skin depth of the varying electromagnetic fields and the resulting eddy currents may be computed by the following equation:

$$d_0 = 500\sqrt{\frac{\rho}{\mu f}} \qquad \text{Equation 3}$$

Wherein:

$d_0$ is the skin depth in centimeters;

$\rho$ is the electrical resistivity of the material in Ohm-centimeters;

$\mu$ is the magnetic permeability of the material in Henrys per centimeter; and f is the frequency of oscillation of the electromagnetic wave in Hertz.

As may be appreciated by inspection of Equation 3, a relatively low frequency of oscillation of the electromagnetic wave may, according to Equation 3, increase the skin depth of the electromagnetic flux. Correspondingly, a relatively high frequency of oscillation of the electromagnetic wave may, according to Equation 3, decrease the magnitude of the skin depth $d_0$ of the electromagnetic flux of the induction coil 26. Also, as mentioned hereinabove, electrical resistivity of molten material 50 may vary widely in relation to their temperature. Therefore, one factor that influences the skin depth $d_0$ may relate to the temperature of the molten material 50.

Accordingly, in another aspect of the present invention, it may be desirable to select the region of influence of the electromagnetic flux of the induction coil so as to indicate the temperature of the region of interest. Put another way, the electrical parameters of the power source 100 may be adjusted so as to generate a flux having an anticipated penetration depth (inwardly from the exterior of the molten material 50 and not including the skull layer 52) or skin depth $d_0$, which corresponds to a selected region of the molten material 50 for which the average temperature is of interest.

Figure 7:
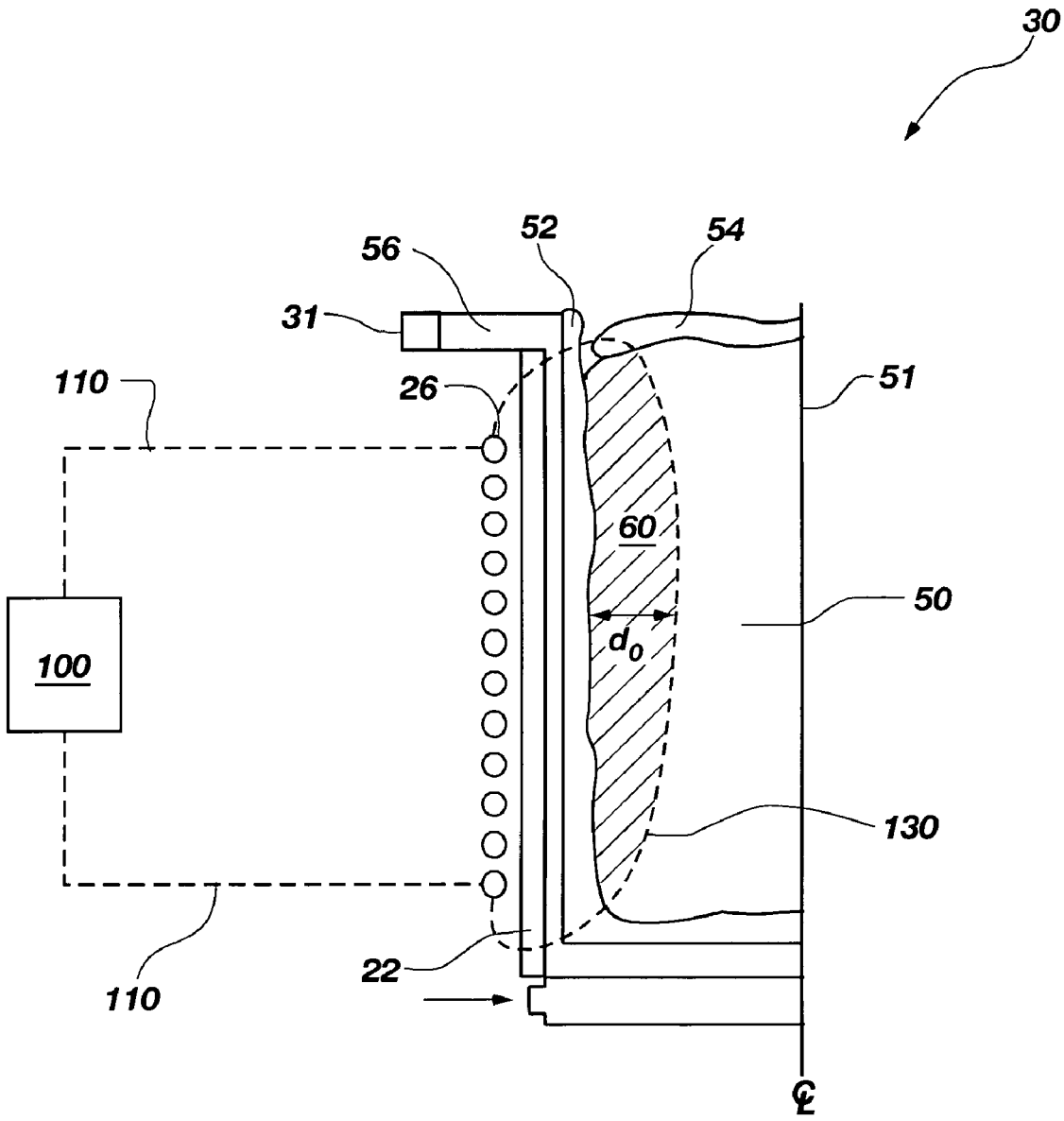
FIG. 7 illustrates an enlarged, schematic, partial side cross-sectional view of the cold-crucible-induction melter shown in FIG. 2D.

Explaining further, for example, as shown in FIG. 7, which shows a schematic side cross-sectional view of crucible 56 during operation, where molten material 50 forms the primary contents thereof, an indication of the temperature of a region 60 of the molten material 50 may be indicated by selecting the operational parameters of the power source 100 so as to generate a flux having an anticipated skin depth $d_0$. Skin depth $d_0$ is illustrated by the overlap between the electromagnetic flux envelope 130 and the molten material 50. It may be appreciated, however, that such a depiction is merely illustrative, and an actual electromagnetic flux field may continuously decay (e.g., exponentially) with distance from the induction coil 26.

It should also be noted that while the electromagnetic flux envelope 130 may be described and may be mathematically treated as being substantially symmetric, substantially cylindrical, or being both substantially symmetric and substantially cylindrical, the distribution of electrical heating within molten material 50 by way of an induction coil 26 may be uneven in nature, depending on the geometry and properties of the molten material 50, the proximity of the induction coil 26 to the molten material 50, the geometry of the induction coil 26, or other environmental conditions that may influence the electromagnetic flux of the induction coil 26 in relation to the molten material 50. The present invention contemplates that such unevenness may be modeled, predicted, or otherwise compensated for so as to increase the efficiency of the induction heating process.

Thus, such an electromagnetic flux may indicate, in combination with measurements of at least one electrical property of the induction heating system 90 and by using Equations 1 and 2, the electrical resistance of a selected region 60 of molten material 50 influenced by the electromagnetic flux. Then, an average temperature may be estimated or determined by determining the electrical resistance of the region of molten material 50 influenced by the electromagnetic flux and correlating the electrical resistance with a temperature, by way of, for instance, the relationship depicted in FIG. 4.

Figure 8:
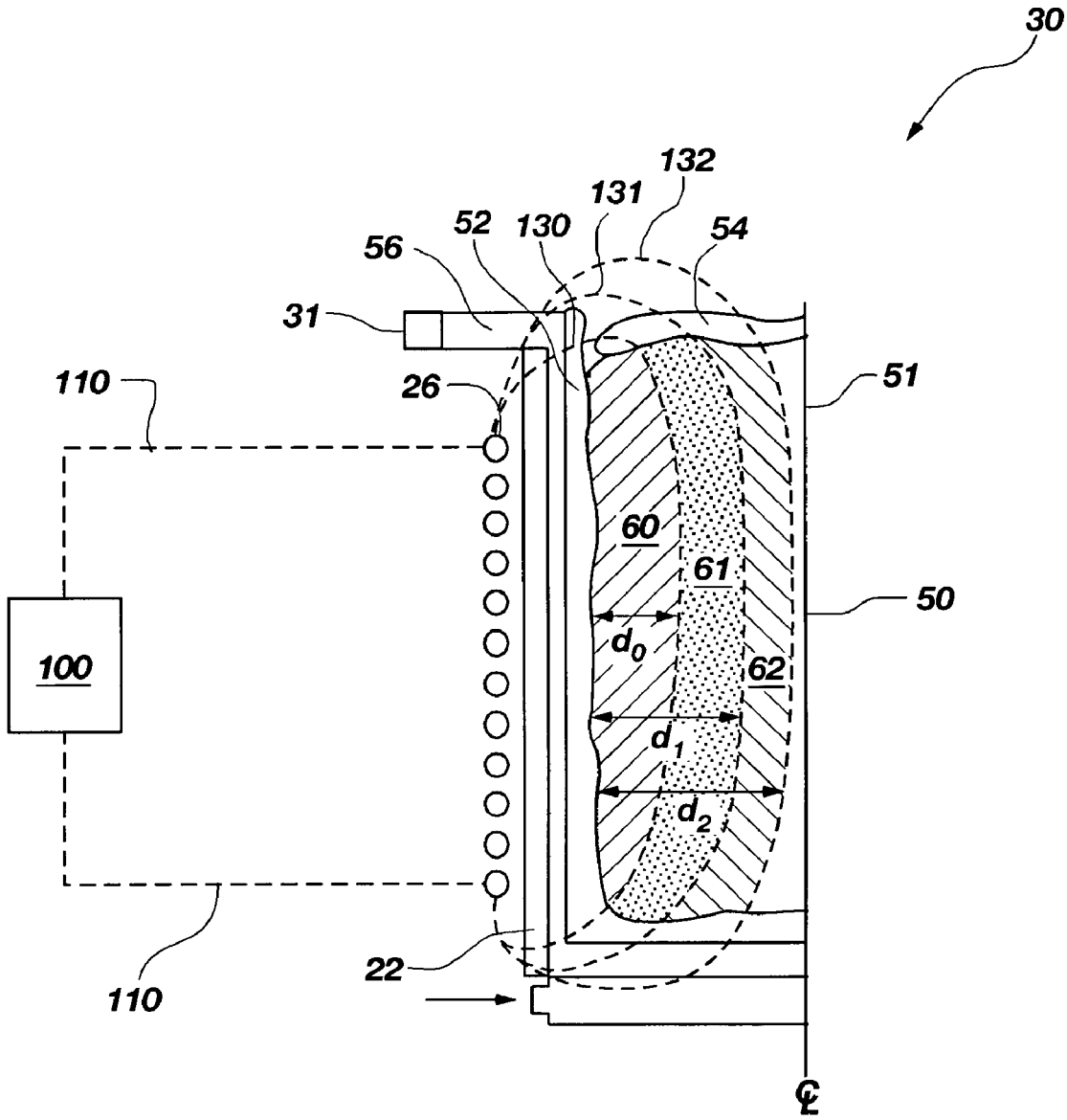
FIG. 8 illustrates an enlarged, schematic, partial side cross-sectional view of the cold-crucible-induction melter shown in FIG. 2D.

By way of extension, one or more indications of the temperature related to one or more regions of the molten material 50, respectively, may be indicated by selecting the operational parameters of the power source 100 so as to generate an electromagnetic flux having differing anticipated skin depths. Accordingly, a respective measurement or indication of a temperature associated with each of a plurality of differing regions of molten material 50 may be obtained. For instance, FIG. 8 shows a schematic side cross-sectional view of crucible 56 during operation, where molten material 50 forms the primary contents thereof. Skin depths $d_0$, $d_1$, and $d_2$ are illustrated by the respective overlap between the electromagnetic flux envelopes 130, 131, and 132 and the molten material 50. However, it should be understood that electromagnetic flux envelope 131 is inclusive of both regions 60 and 61 of molten material 50. Also, electromagnetic flux envelope 132 includes regions 60, 61, and 62.

The average temperature of region 60 may be obtained by energizing the induction coil 26 with an alternating current that produces an anticipated electromagnetic flux envelope 130 as follows. First, the electrical resistance of region 60 may be measured or indicated by employing the above-described circuit analysis and solving for $R_M$. Then, the average electrical resistance of region 60 may be correlated to the temperature of region 60 by way of a relationship therebetween (e.g., as shown in FIG. 4).

Similarly, average temperature of regions 60 and 61 may be obtained by energizing the induction coil 26 with an alternating current that produces an anticipated electromagnetic flux envelope 131 as follows. First, the electrical resistance of regions 60 and 61 may be measured or indicated by employing the above-described circuit analysis and solving for $R_M$. Then, the average electrical resistance of regions 60 and 61 may be correlated to the temperature of regions 60 and 61 by way of a relationship therebetween (e.g., as shown in FIG. 4).

However, by knowing the volume of each of regions 60 and 61, the average temperature of region 61 may be calculated by knowing both the average temperature of region 60 as well as the average temperature of both of the combination of regions 60 and 61.

Moreover, average temperature of regions 60, 61 and 62 may be obtained by energizing the induction coil 26 with an alternating current that produces an anticipated electromagnetic flux envelope 132 as follows. First, the electrical resistance of regions 60, 61 and 62 may be measured or indicated by employing the above-described circuit analysis and solving for $R_M$. Then, the average electrical resistance of regions 60, 61 and 62 may be correlated to the temperature of regions 60, 61, and 62 by way of a relationship therebetween (e.g., as shown in FIG. 4).

However, by knowing the volume of each of regions 60, 61, and 62, the average temperature of region 62 may be calculated by knowing both the average temperatures of region 60, region 61, and the average temperature of all of regions 60, 61, and 62.

Alternatively or additionally, a value for $R_M$, in combination with other induction heating circuit measurements such as inductor voltage, current, and phase may be useful in determining a so-called melt temperature profile, which may be used for approximating or predicting the general behavior of an induction heating system during operation thereof. Determining a melt temperature profile according to a plurality of different regions (i.e., varying the frequency so that the size and shape of the electromagnetic flux changes) of a material that is induction heated, as described hereinabove with respect to FIG. 8, may be advantageous in reducing error in a melt temperature profile or providing additional, useful information relating to the behavior of an induction heating system.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Therefore, the invention is to cover all modifications, equivalents, and alternatives falling within the spirit and scope of the invention as defined by the following appended claims.

What is claimed is:

1. A method of operating an induction heating apparatus, comprising:

providing a crucible having a wall disposed about a longitudinal axis and a bottom extending generally radially inwardly from the wall toward the longitudinal axis;

cooling the wall of the crucible;

providing at least one material within the crucible;

providing an inductor proximate the crucible and in operable communication with an induction heating circuit including a power source;

indicating an electrical resistance of the at least one material;

selecting at least one alternating current characteristic in response to the indicated electrical resistance of the at least one material; and energizing the inductor with an alternating current exhibiting the at least one selected alternating current characteristic.

2. The method of claim 1, wherein selecting the at least one alternating current characteristic comprises selecting at least one of a frequency and an amplitude of the alternating current.

3. The method of claim 1, further comprising melting the at least one material within the crucible to form a molten material substantially filling the crucible.

4. The method of claim 1, wherein the at least one alternating current characteristic is selected for minimizing a difference between a desired electrical resistance and the indicated electrical resistance of the at least one material.

5. The method of claim 4, wherein minimizing the difference between the desired electrical resistance and the indicated electrical resistance of the at least one material comprises causing the indicated electrical resistance of the at least one material to change.

6. The method of claim 4, further comprising:

modeling the induction heating circuit including the inductor, the at least one material, and the power source; and calculating the indicated electrical resistance of the at least one material by mathematical analysis of the modeling of the induction heating circuit in combination with at least one measurement of at least one electrical characteristic of the induction heating circuit.

7. The method of claim 4, further comprising energizing the inductor in response to the difference between the desired electrical resistance and the indicated electrical resistance of the at least one material.

8. The method of claim 7, further comprising implementing a feedback control loop configured for energizing the inductor to minimize the difference between the desired electrical resistance and the indicated electrical resistance of the at least one material.

9. The method of claim 8, wherein the feedback control loop implements a proportional, integral, and derivative type control algorithm.

10. The method of claim 8, wherein the feedback control loop includes an estimator for estimating a value of the indicated electrical resistance of the at least one material.

11. The method of claim 1, further comprising selecting at least one region of the at least one material for determining the electrical resistance thereof.

12. The method of claim 11, wherein selecting the at least one alternating current further comprises selecting at least one of a frequency and an amplitude.

13. The method of claim 1, further comprising heating a susceptor positioned within the crucible by energizing the inductor.

14. The method of claim 13, further comprising observing the susceptor.

15. The method of claim 14, wherein observing the susceptor comprises determining a position of the susceptor.

16. The method of claim 14, wherein observing the susceptor comprises determining if at least a portion of the at least one material within the crucible has melted.

17. A method of operating an induction heating apparatus, comprising:

providing a crucible having a wall disposed about a longitudinal axis and a bottom extending generally radially inwardly from the wall toward the longitudinal axis;

cooling the wall of the crucible;

providing at least one material within the crucible;

providing an inductor proximate the crucible and in operable communication with an induction heating circuit including a power source;

indicating a temperature of the at least one material by measuring an electrical resistance of the at least one material and correlating the measured electrical resistance to the temperature thereof;

selecting at least one alternating current characteristic in response to the indicated temperature of the at least one material; and energizing the inductor with an alternating current exhibiting the at least one selected alternating current characteristic.

18. The method of claim 17, wherein selecting the at least one alternating current characteristic comprises selecting at least one of a frequency and an amplitude.

19. The method of claim 17, further comprising melting the at least one material within the crucible to form a molten material substantially filling the crucible.

20. The method of claim 17, wherein the at least one alternating current characteristic is selected for minimizing a difference between a desired temperature and the indicated temperature of the at least one material.

21. The method of claim 20, wherein minimizing the difference between the desired temperature and the indicated temperature of the at least one material comprises causing the measured electrical resistance of the at least one material to change.

22. The method of claim 20, further comprising:

modeling the induction heating circuit including the inductor, the at least one material, and the power source; and calculating the measured electrical resistance of the at least one material by mathematical analysis of the modeling of the induction heating circuit in combination with at least one measurement of at least one electrical characteristic of the induction heating circuit.

23. The method of claim 20, further comprising energizing the inductor in response to difference between the desired temperature and the indicated temperature of the at least one material.

24. The method of claim 20, further comprising implementing a feedback control loop configured for energizing the inductor to minimize the difference between the desired temperature and the indicated temperature of the at least one material.

25. The method of claim 23, further comprising implementing a PID algorithm within the feedback control loop.

26. The method of claim 23, further comprising implementing an estimator for estimating a value of the measured electrical resistance of the at least one material within the feedback control loop.

27. The method of claim 17, further comprising selecting at least one region of the at least one material for measuring an electrical resistance thereof.

28. The method of claim 27, wherein selecting the at least one alternating current characteristic comprises selecting at least one of a frequency and an amplitude of the alternating current for energizing the inductor.

29. The method of claim 17, further comprising heating a susceptor positioned within the crucible by energizing the inductor.

30. The method of claim 29, further comprising observing the susceptor.

31. The method of claim 30, wherein observing the susceptor comprises determining a position of the susceptor.

32. The method of claim 30, wherein observing the susceptor comprises determining if at least a portion of the at least one material within the crucible has melted.

33. A method of determining a temperature of at least one material within an induction heating apparatus, comprising:

providing a crucible having a wall disposed about a longitudinal axis and a bottom extending generally radially inwardly from the wall toward the longitudinal axis;

cooling the wall of the crucible;

providing at least one material within the crucible;

providing an inductor proximate the crucible in operable communication with an induction heating circuit including a power source;

measuring an electrical resistance of at least one region of the at least one material within the crucible; and determining a temperature of the at least one region of the at least one material by correlating the measured electrical resistance of the at least one region of the at least one material to a temperature thereof.

34. The method of claim 33, wherein:

measuring the electrical resistance of the at least a region of the at least one material within the crucible comprises measuring the electrical resistance of more than one region of the at least one material within the crucible; and determining the temperature of the at least one region of the at least one material comprises determining a temperature of each of the more than one region of the at least one material by correlating the measured electrical resistance of each of the more than one region of the at least one material to a temperature thereof, respectively.

35. The method of claim 34, wherein measuring the electrical resistance of more than one region of the at least one material within the crucible comprises generating a skin depth corresponding to each of the more than one region, respectively, of an electromagnetic flux of the inductor within the at least one material.

36. The method of claim 33, further comprising:

modeling the induction heating circuit including the inductor, the at least one material, and the power source; and calculating the electrical resistance of at least a region of the at least one material via mathematical analysis of the modeling of the induction heating circuit in combination with at least one measurement of at least one electrical characteristic of the induction heating circuit.

37. An induction heating apparatus, comprising:

a crucible;

a cooling structure disposed about the crucible for cooling thereof;

an inductor disposed proximate the crucible;

an induction heating circuit including a power supply having an electrical output operably coupled to the inductor and configured for delivering an alternating current therethrough;

a measurement device configured for indicating an electrical resistance of an anticipated at least one material positioned within the crucible for inductive heating via energizing the inductor; and a controller configured for selecting at least one characteristic of the alternating current for energizing the inductor in response to the indicated electrical resistance of the anticipated at least one material.

38. The induction heating apparatus of claim 37, wherein the controller is configured for minimizing a difference between a desired electrical resistance and the indicated electrical resistance of the anticipated at least one material.

39. The induction heating apparatus of claim 37, wherein the controller is configured for selecting at least one of a frequency and an amplitude of the alternating current for energizing the inductor.

40. The induction heating apparatus of claim 39, further comprising at least one sensor for measuring at least one electrical property of the induction heating circuit for indicating the electrical resistance of the anticipated at least one material.

41. The induction heating apparatus of claim 37, further comprising a susceptor configured for heating the anticipated at least one material, when positioned within the crucible by contact therewith, wherein the susceptor is sized and configured for inductive heating by way of energizing the inductor.

* * * * *